US008864453B2

(12) United States Patent
Spracher et al.

(10) Patent No.: US 8,864,453 B2
(45) Date of Patent: Oct. 21, 2014

(54) NEAR FLOW PATH SEAL FOR A TURBOMACHINE

(75) Inventors: David Randolph Spracher, Simpsonville, SC (US); John Wesley Harris, Jr., Taylors, SC (US); Brian Denver Potter, Greer, SC (US); Zachary James Taylor, Greenville, SC (US); Ryan Zane Ziegler, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 366 days.

(21) Appl. No.: 13/354,610

(22) Filed: Jan. 20, 2012

(65) Prior Publication Data

US 2013/0189087 A1 Jul. 25, 2013

(51) Int. Cl.
*F01D 11/00* (2006.01)

(52) U.S. Cl.
USPC ..... 415/173.7

(58) Field of Classification Search
USPC ..... 416/198 A, 198 R; 415/173.7, 174.5, 230
See application file for complete search history.

(56) References Cited

U.S. PATENT DOCUMENTS

| | | | | |
|---|---|---|---|---|
| 3,551,068 | A * | 12/1970 | Scalzo et al. | 416/198 A |
| 4,645,424 | A | 2/1987 | Peters | |
| 4,669,959 | A | 6/1987 | Kalogeros | |
| 4,880,354 | A | 11/1989 | Teranishi et al. | |
| 5,833,244 | A | 11/1998 | Salt et al. | |
| 6,464,453 | B2 | 10/2002 | Toborg et al. | |
| 6,558,118 | B1 | 5/2003 | Brisson et al. | |
| 7,220,099 | B2 | 5/2007 | Bekrenev et al. | |
| 7,252,481 | B2 | 8/2007 | Stone | |
| 7,410,345 | B2 | 8/2008 | Bracken | |
| 7,488,153 | B2 | 2/2009 | Reigl | |
| 7,520,718 | B2 | 4/2009 | Engle | |
| 8,221,062 | B2 | 7/2012 | Liotta et al. | |
| 2003/0180141 | A1 | 9/2003 | Kress et al. | |
| 2005/0129525 | A1 | 6/2005 | Bekrenev et al. | |
| 2005/0254958 | A1 | 11/2005 | Stone | |
| 2007/0014668 | A1 | 1/2007 | Engle | |

(Continued)

FOREIGN PATENT DOCUMENTS

| | | |
|---|---|---|
| CN | 2337319 Y | 9/1999 |
| GB | 2272946 A | 6/1994 |

OTHER PUBLICATIONS

Rusetskiy, et al. "Gas Turbine packages of average capacity: the aspects of development". Gas Turbo Technology. Issue 2, 2009. HTTP://www.gtt.ru/en.

(Continued)

*Primary Examiner* — Richard Edgar
(74) *Attorney, Agent, or Firm* — Cantor Colburn LLP

(57) ABSTRACT

A near flow path seal member for a turbomachine includes a seal body having a seal support member including a first end portion that extends to a second end portion through an intermediate portion. An arm member extends from the first end portion of the seal body. The arm member has a first end that extends to a second end to define an axial dimension of the arm member, a first edge that extends to a second, opposing edge to define a circumferential dimension of the arm member, and a surface having a profile that establishes a thickness variation of the arm member in each of the axial dimension and the circumferential dimension.

18 Claims, 6 Drawing Sheets

(56) References Cited

U.S. PATENT DOCUMENTS

| | | | |
|---|---|---|---|
| 2008/0008581 | A1 | 1/2008 | Pilecki |
| 2008/0008582 | A1 | 1/2008 | Pickens et al. |
| 2008/0050233 | A1 | 2/2008 | Steiger et al. |
| 2008/0112793 | A1 | 5/2008 | Lee et al. |
| 2008/0145216 | A1 | 6/2008 | Klasing et al. |
| 2009/0004021 | A1 | 1/2009 | Baumhauer et al. |
| 2010/0074731 | A1 | 3/2010 | Wiebe et al. |
| 2010/0178160 | A1 | 7/2010 | Liotta et al. |
| 2010/0196164 | A1 | 8/2010 | Liotta et al. |
| 2010/0232938 | A1 | 9/2010 | Harris, Jr. et al. |
| 2010/0232939 | A1 | 9/2010 | Piersall et al. |
| 2010/0239432 | A1 | 9/2010 | Liang |
| 2010/0254805 | A1 | 10/2010 | Garcia-Crespo et al. |
| 2011/0163506 | A1 | 7/2011 | Hafner |
| 2012/0003079 | A1 | 1/2012 | Farrell et al. |

OTHER PUBLICATIONS

Chinese Office Action for CN Application No. 201110189823.X, dated Jun. 5, 2014, pp. 1-16.

* cited by examiner

NEAR FLOW PATH SEAL FOR A TURBOMACHINE

BACKGROUND OF THE INVENTION

The subject matter disclosed herein relates to the art of turbomachines and, more particularly, to a near flow path seal for a turbomachine.

Turbomachines include a casing that houses a turbine. The turbine includes a plurality of blades or buckets that extend along a gas path. The buckets are supported by a number of turbine rotors that define a plurality of turbine stages. A combustor assembly generates hot gases that are passed through a transition piece toward the plurality of turbine stages. In addition to hot gases from the combustor assembly, gases at a lower temperature flow from a compressor toward a wheelspace of the turbine. The lower temperature gases provide cooling for the rotors as well as other internal components of the turbine. In order to prevent hot gases from entering the wheelspace, the turbine includes near flow path seals that are arranged between adjacent rotors. The near flow path seals are configured to fit closely adjacent the rotors or buckets to reduce leakage from the gas path into the wheelspace.

BRIEF DESCRIPTION OF THE INVENTION

According to one aspect of the exemplary embodiment, a near flow path seal member for a turbomachine includes a seal body having a seal support member including a first end portion that extends to a second end portion through an intermediate portion. An arm member extends from the first end portion of the seal body. The arm member has a first end that extends to a second end to define an axial dimension of the arm member, a first edge that extends to a second, opposing edge to define a circumferential dimension of the arm member, and a surface having a profile that establishes a thickness variation of the arm member in each of the axial dimension and the circumferential dimension.

According to another aspect of the exemplary embodiment, a turbomachine includes a compressor portion, a combustor assembly fluidly connected to the compressor portion, and a turbine portion fluidly connected to the combustor assembly and mechanically linked to the compressor portion. The turbine portion includes a first stage, a second stage, a third stage and a fourth stage. A near flow path seal member is positioned between one of the first, second, third, and fourth stages of the turbine portion. The near flow path seal member includes a seal body having a seal support member including a first end portion that extends to a second end portion through an intermediate portion, and an arm member that extends from the first end portion of the seal body. The arm member having a first end that extends to a second end to define an axial dimension of the arm member, a first edge that extends to a second, opposing edge to define a circumferential dimension of the arm member, and a surface having a profile that establishes a thickness variation of the arm member in each of the axial dimension and the circumferential dimension.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
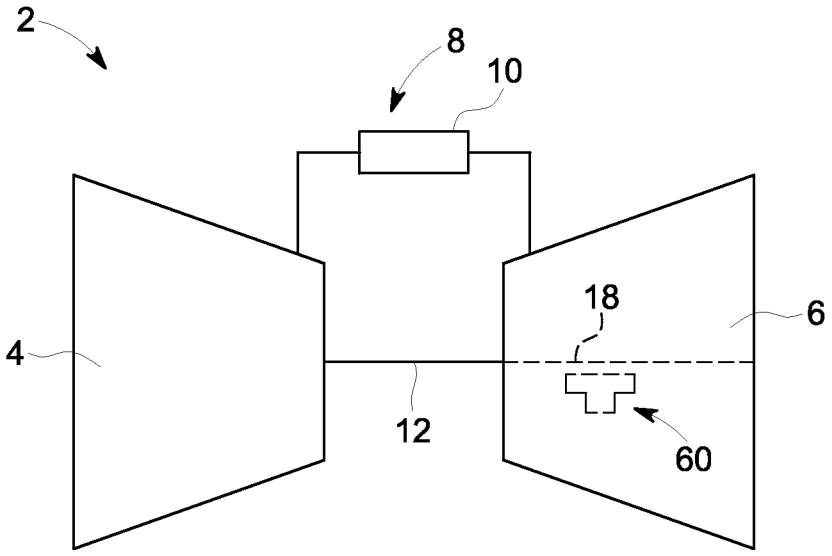
FIG. 1 is a schematic diagram of a turbomachine including a turbine portion having a near flow path seal member in accordance with an exemplary embodiment.
Figure 2:
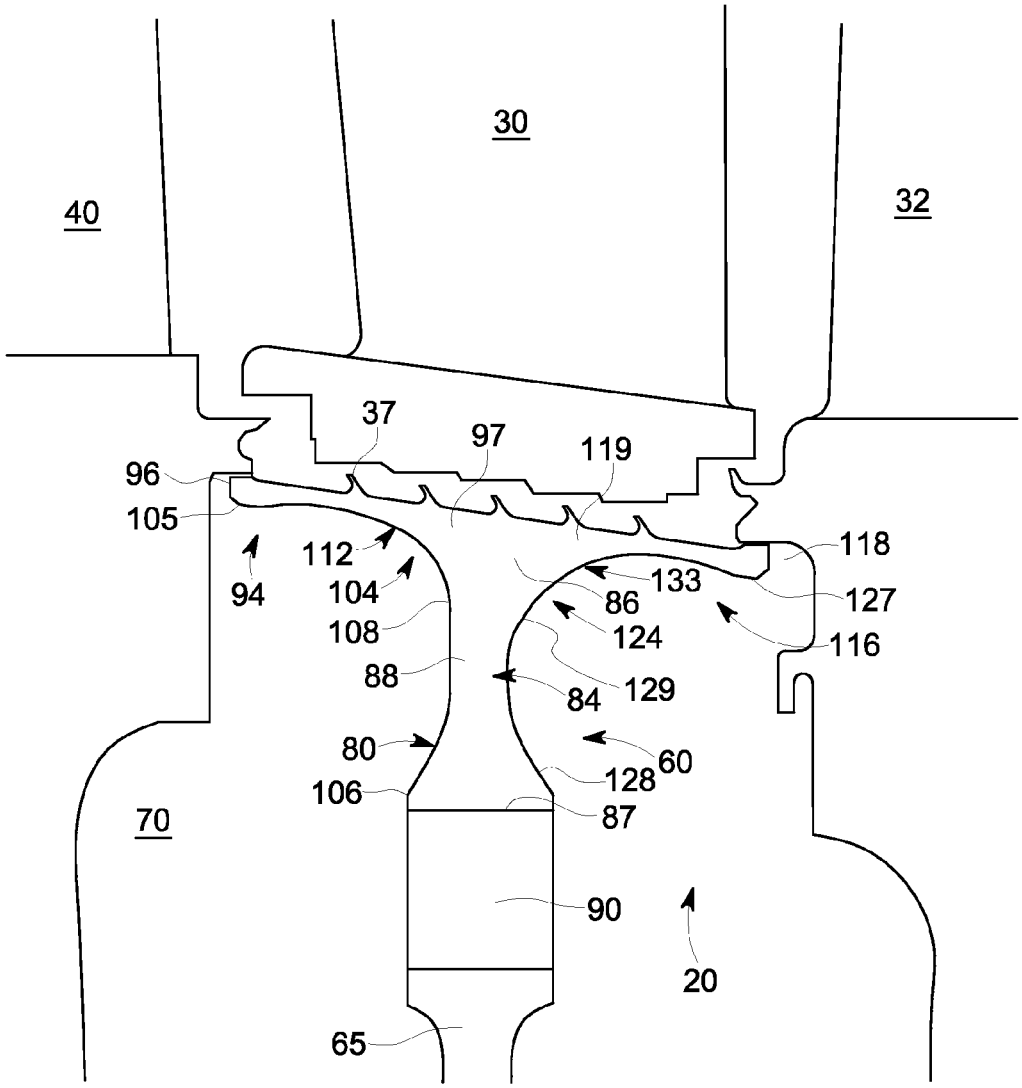
FIG. 2 is a partial cross-sectional side view of the turbine portion of FIG. 1 including a near flow path seal member arranged between turbine stages.

With reference to FIGS. 1 and 2, a turbomachine constructed in accordance with an exemplary embodiment is indicated generally at 2. Turbomachine 2 includes a compressor portion 4 operatively connected to a turbine portion 6. A combustor assembly 8 is fluidly connected to compressor portion 4 and turbine portion 6. Combustor assembly 8 is formed from a plurality of circumferentially spaced combustors, one of which is indicated at 10. Of course it should be understood that combustor assembly 8 could include other arrangements of combustors. Compressor portion 4 is also linked to turbine portion 6 through a common compressor/turbine shaft 12. Combustor assembly 8 delivers products of combustion through a transition piece (not shown) to a gas path 18 in turbine portion 6. The products of combustion expand through turbine portion 6, for example, power a generator, to a pump, an aircraft or the like.

In the exemplary embodiment shown, turbine portion 6 includes a number of stages one of which is shown at 20. Of course it should be understood that the number of stages in turbine portion 6 could vary. Stage 20 includes a plurality of stators or nozzles, one of which is indicated at 30, and a plurality of buckets or blades, one of which is indicated at 32, mounted to a rotor wheel (not shown). In the exemplary embodiment shown, another plurality of blades or buckets, one of which is indicated at 40 is arranged upstream of nozzle 30. Bucket 40 form part of an upstream stage in turbine portion 6. Turbomachine 2 is also shown to include a plurality of near flow path seal members one of which is indicated at 60 arranged between buckets 32 and 40 and below nozzle 30. Near flow path seal members 60 are mounted to shaft 12 through a seal member rotor 65. Near flow path seal members 60 are configured to prevent an exchange of gases between gas path 18 and a wheelspace 70 of turbomachine 2. At this point it should be understood that turbomachine 2 includes additional near flow path seal members (not shown) arranged between adjacent stages (also not shown) of turbine portion 6.

Figure 3:
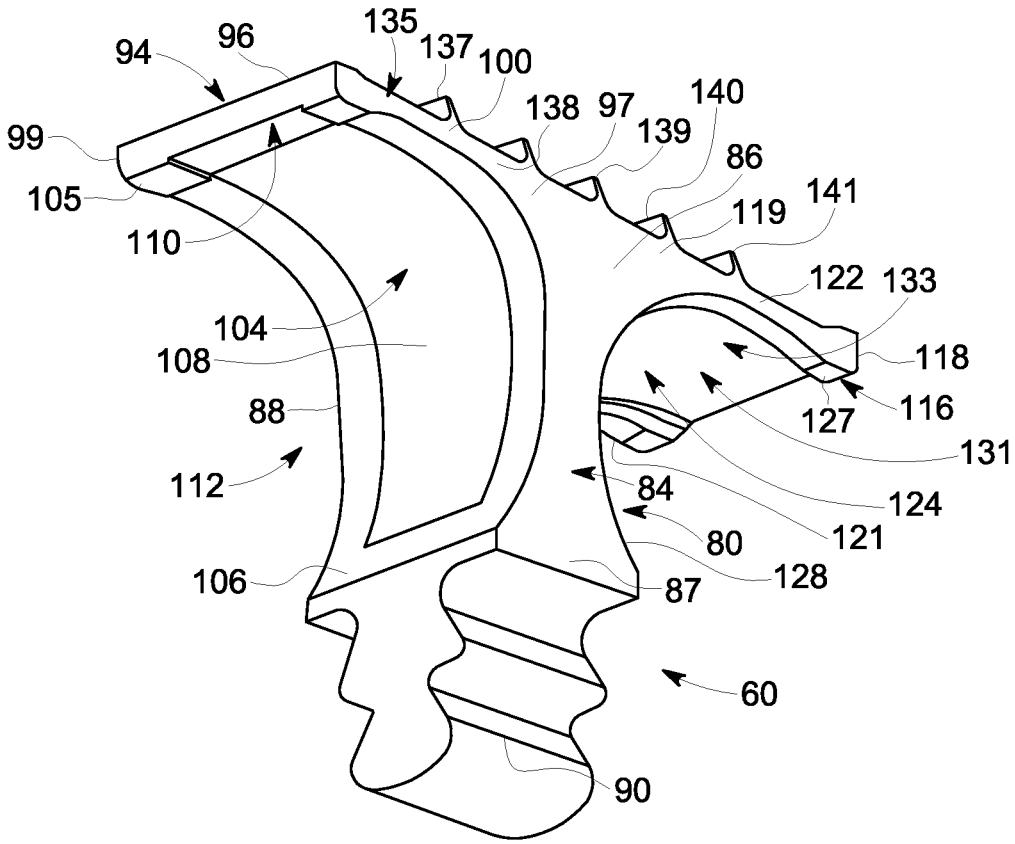
FIG. 3 is a perspective view of a near flow path seal member in accordance with one aspect of the exemplary embodiment.
Figure 4:
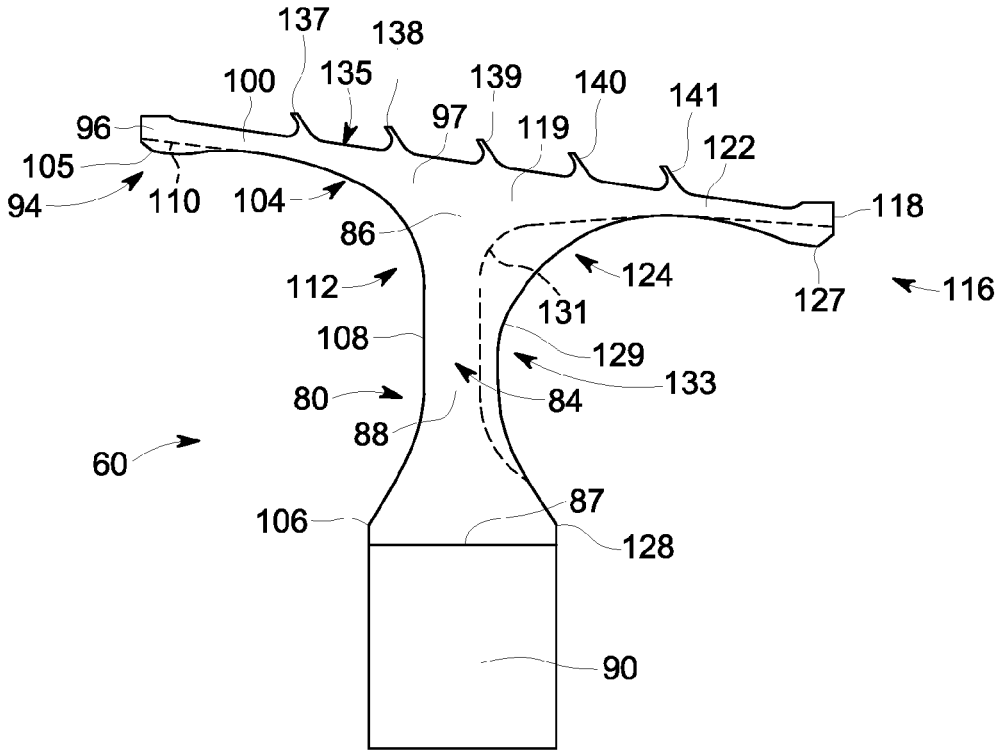
FIG. 4 is a plan view of the near flow path seal member of FIG. 3.

Reference will now be made to FIGS. 3 and 4 in describing near flow path seal member 60 in accordance with an exemplary embodiment. Near flow path seal member 60 includes a seal body 80 having a seal support member 84. Seal support member 84 includes a first end portion 86 that extends to a second end portion 87 through an intermediate portion 88. A dove tail member 90 is provided at second end portion 87 of seal support member 84. Dove tail member 90 provides an interface between near flow path seal member 60 and seal member rotor 65.

Near flow path seal member 60 includes a first arm member 94 that is cantilevered from first end portion 86 of seal support member 84. First arm member 94 includes a first end 96 that extends to a second end 97 that define an axial dimension, and first and second opposing edges 99 and 100 that define a circumferential dimension. Near flow path seal member 60 also includes a first surface section 104. First surface section 104 includes a first end section 105 that extends from first end 96 of first arm member 94 to a second end section 106 through an intermediate section 108. Second end section 106 is positioned at second end portion 87 of seal support member 84. First surface section 104 is also shown to include a recess portion 110 provided at first end section 105. In accordance with the exemplary embodiment, first surface section 104 includes a profile 112 that is defined by a point cloud or set of points listed in TABLE 1 below. The set of points describe X, Y, Z coordinates that define first surface section 104. The particular configuration of profile 112 provides desired clearance and performance properties for near flow path seal member 60. In addition, profile 112 establishes variations in each of the axial and circumferential dimensions. More specifically, a thickness of first arm member 94 varies across each of the axial and circumferential dimensions.

Near flow path seal member 60 also includes a second arm member 116 that is cantilevered from first end portion 86 of seal support member 84. Second arm member 116 includes a first end 118 that extends to a second end 119 that define an axial dimension, and first and second opposing edges 121 and 122 that define a circumferential dimension. Second arm member 116 also includes a second surface section 124. Second surface section 124 includes a first end section 127 that extends from first end 118 of second arm member 116 to a second end section 128 through an intermediate section 129. Second end section 128 is positioned at second end portion 87 of seal support member 84. Second surface section 124 is also shown to include a recess portion 131 provided at first end section 127. In accordance with the exemplary embodiment, second surface section 127 includes a profile 133 that is defined by a point cloud or set of points listed in TABLE 2 below. The set of points describe X, Y, Z coordinates that define surface portion 124. The particular configuration of profile 133 provides desired clearance and performance properties for near flow path seal member 60.

In a manner similar to that described above, profile 133 establishes variations in each of the axial and circumferential dimensions. More specifically, a thickness of second arm member 116 varies between each of the axial and circumferential dimensions. Finally, near flow path seal member 60 is shown to include a seal surface 135 that extends from first end 96 of first arm member 94 to first end 118 of second arm member 116. A plurality of seal elements 137-141 extend outward from and are spaced along seal surface 135. Seal elements 137-141 that cooperate with additional seal elements (not separately labeled) associated with second stage nozzle 37 to establish a labyrinth seal that limits the exchange of fluids between gas path 18 and wheel space 70.

Figure 5:
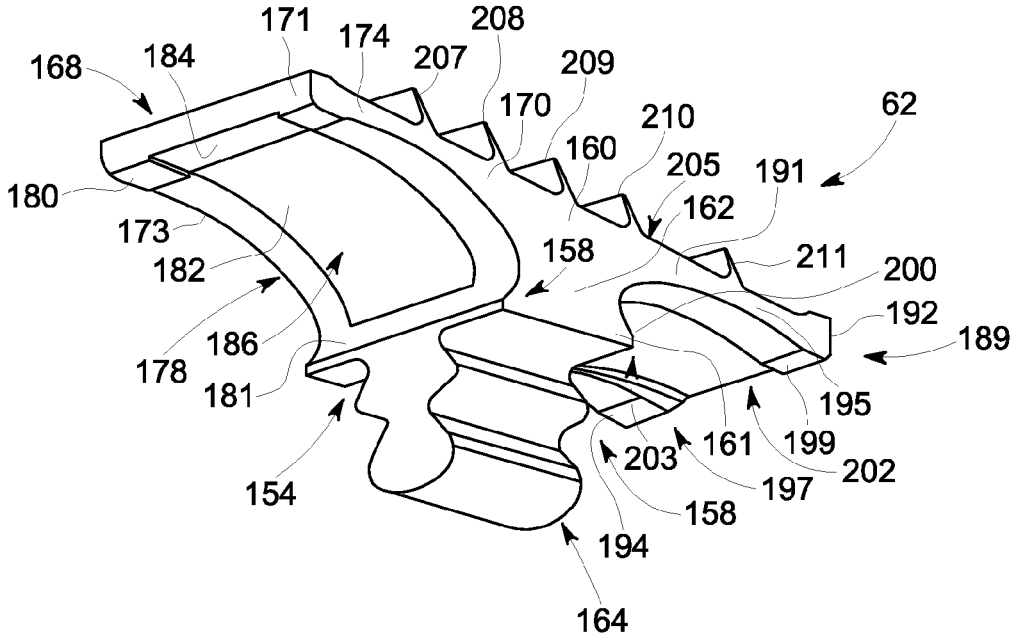
FIG. 5 is a perspective view of a near flow path seal member in accordance with another aspect of the exemplary embodiment.
Figure 6:
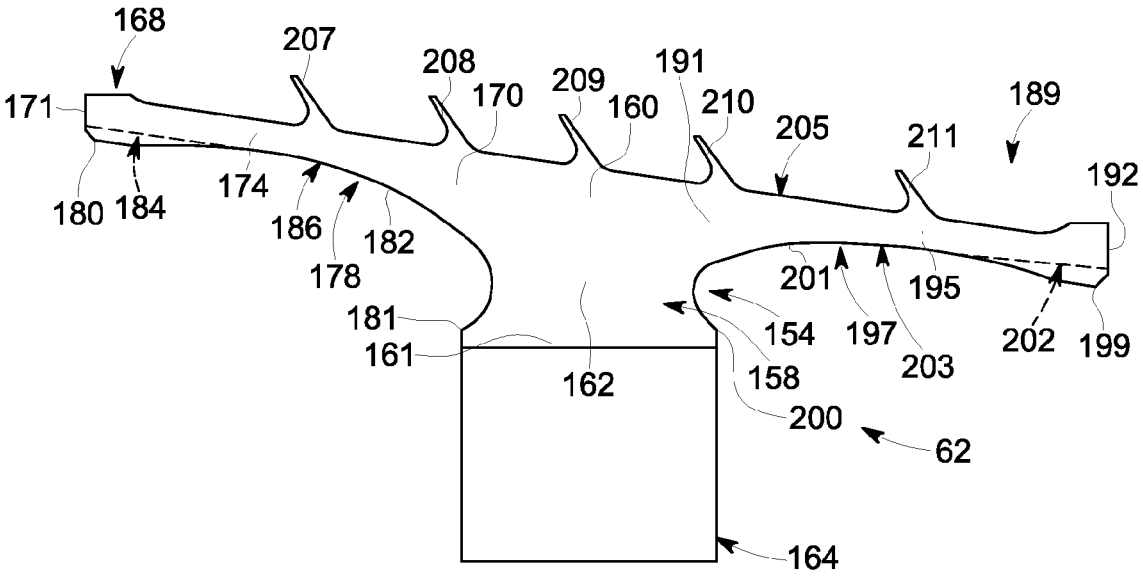
FIG. 6 is a plan view of the near flow path seal member of FIG. 4.

Reference will now follow to FIGS. 5 and 6 in describing near flow path seal member 62. Near flow path seal member 62 includes a seal body 154 having a seal support member 158. Seal support member 158 includes a first end portion 160 that extends to a second end portion 161 through an intermediate portion 162. A dove tail member 164 is provided at second end portion 161 of seal support member 158. Dove tail member 164 provides an interface between near flow path seal member 62 and turbomachine 2.

Near flow path seal member 62 includes a first arm member 168 that is cantilevered from first end portion 160 of seal support member 158. First arm member 168 includes a first end 170 that extends to a second end 171 that define an axial dimension, and first and second opposing edges 173 and 174 that define a circumferential dimension. Near flow path seal member 62 also includes a first surface section 178. First surface section 178 includes a first end section 180 that extends from first end 170 of first arm member 168 to a second end section 181 through an intermediate section 182. Second end section 181 is positioned at second end portion 161 of seal support member 158. First surface section 178 is also shown to include a recess portion 184 provided at first end section 180. In accordance with the exemplary embodiment, first surface section 178 includes a profile 186 that is defined by a point cloud or set of points listed in TABLE 3 below. The set of points describe X, Y, Z coordinates that define first surface section 178. The particular configuration of profile 186 provides desired clearance and performance properties for near flow path seal member 62. In addition, profile 186 establishes variations in each of the axial and circumferential dimensions. More specifically, a thickness of first arm member 168 varies between each of the axial and circumferential dimensions.

Near flow path seal member 62 also includes a second arm member 189 that is cantilevered from first end portion 160 of seal support member 158. Second arm member 189 includes a first end 191 that extends to a second end 192 that define an axial dimension, and first and second opposing edges 194 and 195 that define a circumferential dimension. Near flow path seal member 62 also includes a second surface section 197. Second surface section 197 includes a first end section 199 that extends from first end 191 of second arm member 189 to a second end section 200 through an intermediate section 201. Second end section 200 is positioned at second end portion 161 of seal support member 158. Second surface section 197 is also shown to include a recess portion 202 provided at first end section 199. In accordance with the exemplary embodiment, second surface section 197 includes a profile 203 that is defined by a point cloud or set of points listed in TABLE 4 below. The set of points describe X, Y, Z coordinates that define second surface section 197. The particular configuration of profile 203 provides desired clearance and performance properties for near flow path seal member 62.

In a manner similar to that described above, profile 203 establishes variations in each of the axial and circumferential dimensions. More specifically, a thickness of second arm member 189 varies between each of the axial and circumferential dimensions. Finally, near flow path seal member 62 is shown to include a seal surface 205 that extends from first end 170 of first arm member 168 to first end 191 of second arm member 189. A plurality of seal elements 207-211 extend outward from and are spaced along seal surface 205. Seal elements 207-211 cooperate with additional seal elements (not separately labeled) associated with third stage nozzle 44 to establish a labyrinth seal that limits the exchange of fluids between gas path 18 and wheel space 70.

Figure 7:
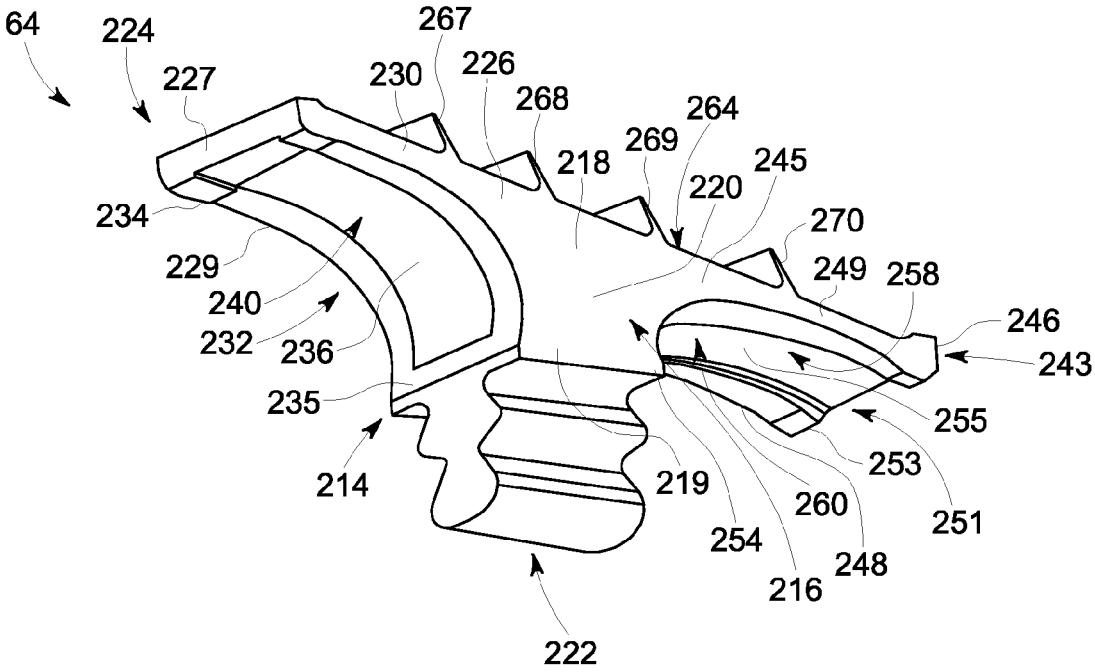
FIG. 7 is a perspective view of a near flow path seal member in accordance with yet another aspect of the exemplary embodiment.
Figure 8:
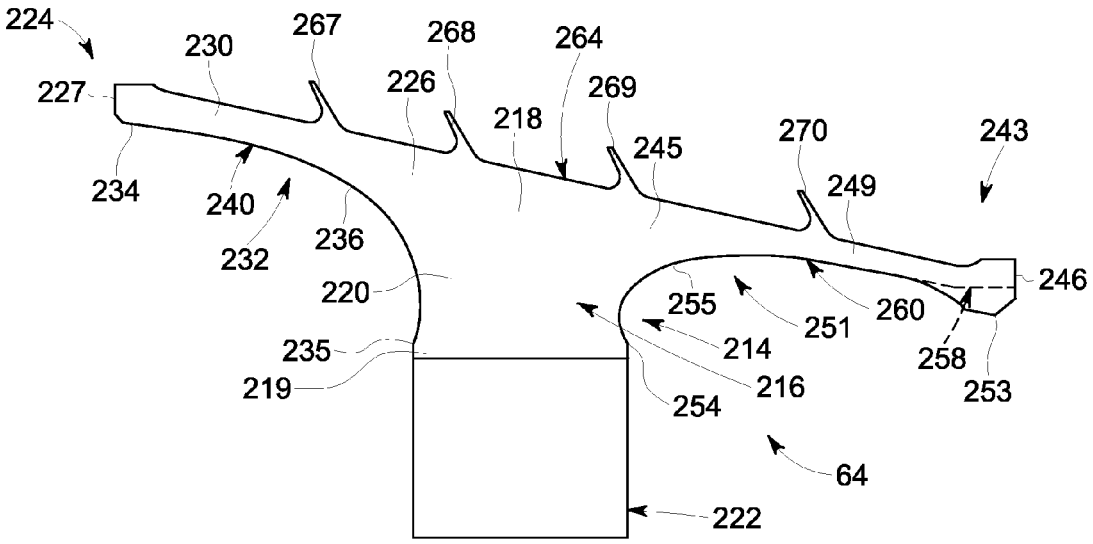
FIG. 8 is a plan view of the near flow path seal member of FIG. 7.

Reference will now follow to FIGS. 7 and 8 in describing near flow path seal member 64. Near flow path seal member 64 includes a seal body 214 having a seal support member 216. Seal support member 216 includes a first end portion 218 that extends to a second end portion 219 through an intermediate portion 220. A dove tail member 222 is provided at second end portion 219 of seal support member 216. Dove tail member 222 provides an interface between near flow path seal member 64 and turbomachine 2.

Near flow path seal member 64 includes a first arm member 224 that is cantilevered from first end portion 218 of seal support member 216. First arm member 224 includes a first end 226 that extends to a second end 227 that define an axial dimension, and first and second opposing edges 229 and 230 that define a circumferential dimension. Near flow path seal member 64 also includes a first surface section 232. First surface section 232 includes a first end section 234 that extends from first end 226 of first arm ember 224 to a second end section 235 through an intermediate section 236. Second end section 235 is positioned at second end portion 219 of seal support member 216. In accordance with the exemplary embodiment, first surface section 232 includes a profile 240 that is defined by a point cloud or set of points listed in TABLE 5 below. The set of points describe X, Y, Z coordinates that define first surface section 232. The particular configuration of profile 240 provides desired clearance and performance properties for near flow path seal member 64. In addition, profile 240 establishes variations in each of the axial and circumferential dimensions. More specifically, a thickness of first arm member 224 varies between each of the axial and circumferential dimensions.

Near flow path seal member 64 also includes a second arm member 243 that is cantilevered from first end portion 218 of seal support member 216. Second arm member 243 includes a first end 245 that extends to a second end 246 that define an axial dimension, and first and second opposing edges 248 and 249 that define a circumferential dimension. Near flow path seal member 64 also includes a second surface section 251. Second surface section 251 includes a first end section 253 that extends from first end 245 of second arm ember 243 to a second end section 254 through an intermediate section 255. Second end section 254 is positioned at second end portion 219 of seal support member 216. Second surface section 251 is also shown to include a recess portion 258 provided at first end section 253. In accordance with the exemplary embodiment, second surface section 251 includes a profile 260 that is defined by a point cloud or set of points listed in TABLE 6 below. The set of points describe X, Y, Z coordinates that define second surface section 251. The particular configuration of profile 260 provides desired clearance and performance properties for near flow path seal member 64.

In a manner similar to that described above, profile 260 establishes variations in each of the axial and circumferential dimensions. More specifically, a thickness of second arm member 243 varies between each of the axial and circumferential dimensions. Finally, near flow path seal member 64 is shown to include a seal surface 264 that extends from first end 226 of first arm member 224 to first end 245 of second arm member 243. A plurality of seal elements 267-270 extend outward from and are spaced along seal surface 264. Seal elements 267-270 cooperate with additional seal elements (not separately labeled) associated with fourth stage nozzle 51 to establish a labyrinth seal that limits the exchange of fluids between gas path 18 and wheel space 70.

TABLE 1

| X | Y | Z |
|---|---|---|
| −0.748 | 0.39 | 43.267 |
| −3.322 | −1.612 | 44.249 |
| −0.5 | 1.155 | 42.35 |
| −4.251 | −0.325 | 44.406 |
| −3.782 | 0.325 | 44.35 |
| −0.748 | −1.923 | 43.267 |
| −1.245 | 0.359 | 39.187 |
| −0.594 | 0.388 | 42.972 |
| −0.544 | 0.388 | 42.798 |
| −3.313 | −0.325 | 44.294 |
| −4.216 | 1.135 | 44.375 |
| −4.112 | 1.433 | 44.244 |
| −3.708 | 1.965 | 44.2 |
| −0.5 | −0.381 | 41.548 |
| −0.5 | −1.143 | 41.147 |
| −2.055 | 1.194 | 44.072 |
| −0.978 | −1.935 | 43.546 |
| −0.544 | −1.902 | 42.798 |
| −3.788 | 1.129 | 44.326 |
| −2.844 | −0.325 | 44.238 |
| −3.313 | −0.975 | 44.294 |
| −2.844 | −0.975 | 44.238 |
| −4.112 | −1.433 | 44.244 |
| −0.5 | −1.143 | 41.949 |
| −4.216 | −1.135 | 44.375 |
| −0.5 | 1.143 | 41.949 |
| −2.055 | −0.398 | 44.072 |
| −2.825 | 1.194 | 44.235 |
| −0.594 | 1.164 | 42.972 |
| −0.748 | 1.923 | 43.267 |
| −4.251 | 0.325 | 44.406 |
| −0.836 | 0.37 | 39.896 |
| −0.585 | −1.11 | 40.499 |
| −3.313 | 0.975 | 44.294 |
| −0.511 | 1.892 | 42.575 |
| −1.04 | −1.076 | 39.541 |
| −0.585 | 1.799 | 40.499 |
| −0.978 | −0.394 | 43.546 |
| −0.594 | −1.91 | 42.972 |
| −0.5 | 1.143 | 41.147 |
| −0.669 | −1.917 | 43.137 |
| −1.323 | −1.946 | 43.785 |
| −4.112 | −1.967 | 44.244 |
| −0.5 | −1.828 | 41.147 |
| −1.323 | 1.194 | 43.785 |
| −3.708 | −1.612 | 44.2 |
| −0.669 | −0.388 | 43.137 |
| −3.782 | 1.267 | 44.255 |
| −0.5 | 1.864 | 41.949 |
| −1.323 | 1.946 | 43.785 |
| −4.112 | 1.967 | 44.244 |
| −3.786 | −1.965 | 44.199 |
| −3.785 | −0.975 | 44.35 |
| −0.5 | −0.381 | 41.147 |
| −2.055 | 0.398 | 44.072 |
| −2.055 | −1.959 | 44.072 |
| −0.594 | −1.164 | 42.972 |
| −2.844 | 0.325 | 44.238 |
| −2.055 | 1.959 | 44.072 |
| −1.141 | 0.394 | 43.679 |
| −0.5 | 0.381 | 41.147 |
| −1.245 | −1.74 | 39.187 |
| −1.141 | −1.941 | 43.679 |
| −0.5 | −1.143 | 41.548 |
| −0.594 | 1.91 | 42.972 |
| −2.437 | 1.963 | 44.17 |
| −4.133 | −1.261 | 44.301 |
| −1.04 | 0.359 | 39.541 |
| −0.544 | 1.902 | 42.798 |
| −0.5 | −1.864 | 41.949 |
| −0.837 | 1.182 | 43.39 |
| −0.978 | 1.935 | 43.546 |
| −0.978 | 1.182 | 43.546 |
| −3.708 | 1.612 | 44.2 |
| −0.837 | −1.928 | 43.39 |
| −0.511 | −0.385 | 42.575 |
| −0.585 | 0.37 | 40.499 |
| −0.748 | −1.171 | 43.267 |

TABLE 1-continued

| X | Y | Z |
|---|---|---|
| −1.683 | −1.194 | 43.944 |
| −1.323 | 0.398 | 43.785 |
| −1.245 | −1.076 | 39.187 |
| −1.04 | −1.756 | 39.541 |
| −2.844 | 0.975 | 44.238 |
| −0.585 | 1.11 | 40.499 |
| −1.04 | 1.076 | 39.541 |
| −3.787 | 1.442 | 44.199 |
| −3.785 | 0.975 | 44.35 |
| −0.978 | 0.394 | 43.546 |
| −1.141 | 1.182 | 43.679 |
| −1.141 | −0.394 | 43.679 |
| −2.825 | 1.966 | 44.235 |
| −0.511 | 1.155 | 42.575 |
| −1.323 | −1.194 | 43.785 |
| −0.748 | 1.171 | 43.267 |
| −0.836 | −1.771 | 39.896 |
| −0.836 | −0.37 | 39.896 |
| −0.5 | 1.846 | 41.548 |
| −0.544 | −0.388 | 42.798 |
| −3.073 | 1.967 | 44.254 |
| −3.786 | 1.965 | 44.199 |
| −0.5 | 1.143 | 41.548 |
| −3.708 | −1.965 | 44.2 |
| −3.377 | −1.151 | 44.269 |
| −2.825 | −1.966 | 44.235 |
| −2.437 | 1.194 | 44.17 |
| −1.683 | 1.194 | 43.944 |
| −2.437 | −1.194 | 44.17 |
| −1.245 | −0.359 | 39.187 |
| −2.825 | −1.195 | 44.235 |
| −0.5 | −1.846 | 41.548 |
| −0.5 | −1.882 | 42.35 |
| −1.141 | 1.941 | 43.679 |
| −3.322 | 1.256 | 44.249 |
| −0.5 | 0.381 | 41.548 |
| −3.322 | 1.612 | 44.249 |
| −2.437 | −0.398 | 44.17 |
| −1.683 | 0.398 | 43.944 |
| −0.5 | −0.381 | 41.949 |
| −0.5 | 0.381 | 41.949 |
| −0.836 | 1.771 | 39.896 |
| −2.055 | −1.194 | 44.072 |
| −2.437 | −1.963 | 44.17 |
| −0.511 | 0.385 | 42.575 |
| −3.787 | −1.442 | 44.199 |
| −0.836 | −1.11 | 39.896 |
| −4.251 | 0.975 | 44.406 |
| −0.5 | 0.385 | 42.35 |
| −3.377 | 1.151 | 44.269 |
| −0.544 | −1.164 | 42.798 |
| −0.836 | 1.11 | 39.896 |
| −1.245 | 1.74 | 39.187 |
| −0.5 | −1.155 | 42.35 |
| −1.683 | 1.953 | 43.944 |
| −0.511 | −1.892 | 42.575 |
| −0.837 | −1.182 | 43.39 |
| −3.322 | −1.967 | 44.249 |
| −1.04 | −0.359 | 39.541 |
| −0.585 | −1.799 | 40.499 |
| −1.323 | −0.398 | 43.785 |
| −0.748 | −0.39 | 43.267 |
| −3.782 | −0.325 | 44.35 |
| −0.5 | 1.882 | 42.35 |
| −0.669 | 1.917 | 43.137 |
| −3.708 | −1.445 | 44.2 |
| −0.978 | −1.182 | 43.546 |
| −0.837 | 0.394 | 43.39 |
| −0.669 | 0.39 | 43.137 |
| −0.669 | 1.171 | 43.137 |
| −1.683 | −0.398 | 43.944 |
| −2.825 | −1.966 | 44.235 |
| −0.5 | −0.385 | 42.35 |
| −0.837 | 1.928 | 43.39 |
| −3.073 | −1.195 | 44.254 |
| −0.5 | 1.828 | 41.147 |
| −0.544 | 1.164 | 42.798 |
| −1.141 | −1.182 | 43.679 |

TABLE 1-continued

| X | Y | Z |
|---|---|---|
| −0.837 | −0.394 | 43.39 |
| −1.04 | 1.756 | 39.541 |
| −1.683 | −1.953 | 43.944 |
| −2.437 | 0.398 | 44.17 |
| −0.669 | −1.171 | 43.137 |
| −0.594 | −0.388 | 42.972 |
| −4.133 | 1.261 | 44.301 |
| −3.313 | 0.325 | 44.294 |
| −0.585 | −0.37 | 40.499 |
| −3.073 | 1.195 | 44.254 |
| −0.837 | 1.928 | 43.39 |
| −0.511 | −1.155 | 42.575 |
| −3.708 | 1.445 | 44.2 |
| −3.322 | 1.967 | 44.249 |
| −1.245 | 1.076 | 39.187 |
| −3.782 | −1.267 | 44.255 |
| −3.322 | −1.256 | 44.249 |
| −3.073 | −1.967 | 44.254 |
| −3.788 | −1.129 | 44.326 |
| −4.251 | −0.975 | 44.406 |

TABLE 2

| X | Y | Z |
|---|---|---|
| 0.25 | −1.208 | 41.746 |
| 0.25 | 0 | 41.997 |
| 0.25 | −1.181 | 40.993 |
| 0.25 | −1.234 | 42.499 |
| 0.25 | −1.221 | 42.123 |
| 0.25 | 1.234 | 42.499 |
| 0.323 | 1.411 | 42.493 |
| 0.25 | 1.208 | 41.746 |
| 0.25 | −0.624 | 41.495 |
| 0.25 | 0 | 41.495 |
| 0.25 | −0.633 | 42.499 |
| 0.25 | 0.624 | 40.993 |
| 0.302 | 1.24 | 42.773 |
| 0.25 | 0 | 40.993 |
| 0.25 | 1.181 | 40.993 |
| 0.25 | −1.195 | 41.37 |
| 0.25 | 0.624 | 42.499 |
| 0.25 | −0.624 | 41.997 |
| 0.25 | −0.624 | 40.993 |
| 0.25 | 1.195 | 41.37 |
| 0.25 | −1.181 | 40.993 |
| 0.25 | 0 | 40.993 |
| 0.25 | 1.181 | 40.993 |
| 0.25 | 0 | 42.499 |
| 0.25 | 0.624 | 41.997 |
| 0.25 | 0.624 | 41.495 |
| 0.302 | −1.24 | 42.773 |
| 0.25 | 1.221 | 42.123 |
| 0.633 | 1.496 | 42.83 |
| 2.527 | −1.928 | 43.371 |
| 2.509 | −0.635 | 43.37 |
| 0.941 | 1.251 | 43.247 |
| 0.446 | −1.453 | 41.766 |
| 0.429 | −1.439 | 41.513 |
| 1.73 | −1.254 | 43.309 |
| 0.449 | −1.246 | 43.009 |
| 0.704 | 1.429 | 43.105 |
| 0.341 | −0.633 | 42.857 |
| 1.265 | −1.737 | 42.85 |
| 0.902 | −1.737 | 42.481 |
| 0.523 | 1.55 | 41.745 |
| 2.527 | 1.928 | 43.371 |
| 1.696 | −1.558 | 43.136 |
| 0.532 | 1.856 | 41.784 |
| 1.986 | 0.635 | 43.329 |
| 1.076 | 1.593 | 42.677 |
| 0.782 | −1.5 | 42.941 |
| 1.464 | −0.635 | 43.288 |
| 1.696 | 1.917 | 43.136 |
| 2.124 | 1.255 | 43.34 |

TABLE 2-continued

| X | Y | Z |
|---|---|---|
| 0.625 | 1.737 | 42.044 |
| 0.5 | 1.844 | 41.509 |
| 0.534 | −1.49 | 42.673 |
| 0.673 | −1.25 | 43.174 |
| 0.625 | 1.868 | 42.044 |
| 2.86 | 1.171 | 43.378 |
| 4.424 | −1.911 | 43.007 |
| 4.489 | 1.184 | 43.209 |
| 2.86 | 0.39 | 43.378 |
| 3.21 | −1.041 | 43.349 |
| 3.191 | −1.081 | 43.349 |
| 4.361 | 1.912 | 43.025 |
| 3.985 | 1.184 | 43.248 |
| 2.992 | −0.975 | 43.37 |
| 4.424 | −1.558 | 43.007 |
| 4.456 | −1.34 | 43.099 |
| 3.191 | 1.926 | 43.349 |
| 3.987 | −0.975 | 43.293 |
| 3.485 | −0.975 | 43.332 |
| 4.361 | −1.56 | 43.025 |
| 3.49 | 0.975 | 43.332 |
| 3.779 | 1.34 | 43.226 |
| 4.982 | 1.185 | 43.17 |
| 4.982 | −1.185 | 43.17 |
| 3.191 | 1.504 | 43.349 |
| 4.982 | −0.975 | 43.217 |
| 4.361 | 1.56 | 43.025 |
| 4.85 | −1.353 | 43.054 |
| 3.191 | 1.171 | 43.349 |
| 3.49 | −0.975 | 43.332 |
| 3.191 | 1.926 | 43.349 |
| 3.835 | −1.203 | 43.25 |
| 4.493 | −0.975 | 43.254 |
| 3.191 | −1.926 | 43.349 |
| 4.796 | 1.578 | 42.956 |
| 3.989 | −0.975 | 43.293 |
| 3.191 | −1.171 | 43.349 |
| 2.86 | −1.171 | 43.378 |
| 3.989 | 0.975 | 43.293 |
| 3.786 | 1.921 | 43.224 |
| 3.835 | 1.203 | 43.25 |
| 3.779 | −1.34 | 43.226 |
| 4.424 | 1.558 | 43.007 |
| 3.985 | −1.184 | 43.248 |
| 3.49 | 0 | 43.332 |
| 0.5 | 1.467 | 42.013 |
| 0.592 | 0 | 43.128 |
| 1.004 | 1.493 | 42.751 |
| 1.004 | −1.493 | 42.751 |
| 1.654 | −1.471 | 43.176 |
| 2.509 | 0.635 | 43.37 |
| 1.336 | 1.252 | 43.278 |
| 0.625 | −1.868 | 42.044 |
| 0.961 | 1.501 | 42.989 |
| 2.096 | −1.425 | 43.295 |
| 1.336 | −1.252 | 43.278 |
| 0.782 | 1.5 | 42.941 |
| 1.37 | 1.602 | 42.933 |
| 0.323 | 1.384 | 41.74 |
| 1.73 | 1.254 | 43.309 |
| 0.5 | −1.484 | 42.491 |
| 1.341 | 1.432 | 43.202 |
| 1.076 | −1.593 | 42.677 |
| 0.825 | −1.582 | 42.378 |
| 2.1 | −1.924 | 43.296 |
| 0.592 | −0.633 | 43.128 |
| 0.673 | 1.25 | 43.174 |
| 0.824 | −1.883 | 42.377 |
| 1.367 | −1.908 | 42.93 |
| 2.509 | −1.259 | 43.37 |
| 1.074 | 1.896 | 42.675 |
| 0.323 | −1.411 | 42.493 |
| 0.625 | 1.57 | 42.044 |
| 1.37 | −1.602 | 42.933 |
| 1.311 | −1.502 | 43.017 |
| 0.323 | −1.384 | 41.74 |
| 1.311 | 1.502 | 43.017 |
| 1.696 | −1.917 | 43.136 |

TABLE 2-continued

| X | Y | Z |
|---|---|---|
| 0.744 | 1.482 | 42.44 |
| 1.464 | 0.635 | 43.288 |
| 0.446 | 1.453 | 41.766 |
| 1.367 | 1.908 | 42.93 |
| 2.124 | −1.255 | 43.34 |
| 0.502 | 1.425 | 42.954 |
| 1.986 | −0.635 | 43.329 |
| 0.704 | −1.429 | 43.105 |
| 0.323 | 1.398 | 42.117 |
| 1.464 | 0 | 43.288 |
| 0.532 | −1.856 | 41.784 |
| 2.096 | 1.425 | 43.295 |
| 2.509 | 1.259 | 43.37 |
| 4.982 | 0.975 | 43.217 |
| 3.786 | 1.504 | 43.224 |
| 4.424 | 1.911 | 43.007 |
| 4.493 | 0.975 | 43.254 |
| 2.992 | 0.975 | 43.37 |
| 4.796 | −1.578 | 42.956 |
| 2.992 | 0 | 43.37 |
| 3.191 | −1.504 | 43.349 |
| 2.86 | −1.928 | 43.378 |
| 3.987 | 0 | 43.293 |
| 4.484 | 0 | 43.255 |
| 4.796 | −1.909 | 42.956 |
| 3.786 | −1.504 | 43.224 |
| 4.85 | 1.353 | 43.054 |
| 4.796 | 1.909 | 42.956 |
| 3.191 | 1.081 | 43.349 |
| 4.361 | −1.912 | 43.025 |
| 3.191 | −1.926 | 43.349 |
| 2.86 | −0.39 | 43.378 |
| 3.21 | 1.041 | 43.349 |
| 4.456 | 1.34 | 43.099 |
| 2.86 | 1.928 | 43.378 |
| 3.786 | −1.921 | 43.224 |
| 4.982 | 0 | 43.217 |
| 4.489 | −1.184 | 43.209 |
| 0.799 | −1.305 | 39.905 |
| 0.5 | −1.598 | 41.147 |
| 0.5 | −1.828 | 41.147 |
| 0.637 | 1.152 | 39.988 |
| 0.907 | 0.598 | 39.753 |
| 0.487 | −1.408 | 40.601 |
| 0.538 | −1.598 | 40.712 |
| 1.245 | −0.359 | 39.187 |
| 0.295 | −1.171 | 40.63 |
| 0.505 | −1.518 | 40.988 |
| 0.613 | −1.379 | 40.236 |
| 0.907 | 0 | 39.753 |
| 0.295 | 1.171 | 40.63 |
| 0.678 | 1.304 | 40.019 |
| 0.426 | −1.161 | 40.288 |
| 0.651 | 1.789 | 40.291 |
| 0.836 | 1.771 | 39.896 |
| 0.673 | −1.465 | 40.234 |
| 0.538 | −1.808 | 40.712 |
| 0.937 | 1.145 | 39.72 |
| 1.04 | 1.076 | 39.541 |
| 0.323 | 1.371 | 41.364 |
| 0.836 | −1.368 | 39.896 |
| 0.474 | 1.313 | 40.308 |
| 0.673 | 1.465 | 40.234 |
| 0.5 | −1.471 | 42.114 |
| 0.5 | −1.535 | 41.509 |
| 1.735 | −1.433 | 43.233 |
| 0.941 | −0.633 | 43.247 |
| 0.902 | 1.737 | 42.481 |
| 2.509 | 0 | 43.37 |
| 1.696 | 1.558 | 43.136 |
| 0.947 | 1.431 | 43.171 |
| 0.341 | 0.633 | 42.857 |
| 0.523 | −1.55 | 41.745 |
| 0.5 | −1.467 | 42.013 |
| 0.941 | 0.633 | 43.247 |
| 2.1 | 1.924 | 43.296 |
| 1.696 | 1.737 | 43.136 |
| 0.961 | −1.501 | 42.989 |

TABLE 2-continued

| X | Y | Z |
|---|---|---|
| 0.592 | 0.633 | 43.128 |
| 1.341 | −1.432 | 43.202 |
| 0.5 | 1.484 | 42.491 |
| 0.625 | −1.737 | 42.044 |
| 1.696 | −1.737 | 43.136 |
| 0.824 | 1.883 | 42.377 |
| 2.077 | 1.376 | 43.305 |
| 0.947 | −1.431 | 43.171 |
| 0.449 | 1.246 | 43.009 |
| 0.744 | −1.482 | 42.44 |
| 2.077 | −1.376 | 43.305 |
| 0.633 | −1.496 | 42.83 |
| 0.502 | −1.425 | 42.954 |
| 0.323 | −1.398 | 42.117 |
| 1.074 | −1.896 | 42.675 |
| 0.341 | 0 | 42.857 |
| 0.941 | 0 | 43.247 |
| 1.986 | 0 | 43.329 |
| 1.654 | 1.471 | 43.176 |
| 0.534 | 1.49 | 42.673 |
| 0.825 | 1.582 | 42.378 |
| 0.369 | 1.418 | 42.74 |
| 0.625 | −1.868 | 42.044 |
| 0.625 | −1.57 | 42.044 |
| 0.369 | −1.418 | 42.74 |
| 1.265 | 1.737 | 42.85 |
| 1.735 | 1.433 | 43.233 |
| 0.625 | 1.868 | 42.044 |
| 0.5 | 1.535 | 41.509 |
| 0.429 | 1.439 | 41.513 |
| 0.941 | −1.251 | 43.247 |
| 0.555 | −0.598 | 40.087 |
| 0.487 | 1.408 | 40.601 |
| 1.245 | 0.359 | 39.187 |
| 0.679 | −1.307 | 40.021 |
| 0.426 | 1.161 | 40.288 |
| 0.651 | −1.598 | 40.291 |
| 1.245 | 1.076 | 39.187 |
| 0.303 | 1.335 | 40.988 |
| 0.505 | 1.518 | 40.988 |
| 0.799 | 1.305 | 39.905 |
| 0.555 | 0.598 | 40.087 |
| 0.328 | 0 | 40.515 |
| 1.04 | 0.359 | 39.541 |
| 0.836 | −1.598 | 39.896 |
| 0.349 | −1.326 | 40.638 |
| 0.328 | 0.598 | 40.515 |
| 1.04 | −1.076 | 39.541 |
| 0.5 | 1.598 | 41.147 |
| 1.245 | −1.74 | 39.187 |
| 0.937 | −0.573 | 39.72 |
| 0.637 | −1.152 | 39.988 |
| 0.538 | 1.598 | 40.712 |
| 0.555 | 0 | 40.087 |
| 0.432 | 1.422 | 40.985 |
| 0.937 | −1.145 | 39.72 |
| 0.538 | 1.808 | 40.712 |
| 1.04 | 1.756 | 39.541 |
| 0.651 | −1.789 | 40.291 |
| 0.937 | 0.573 | 39.72 |
| 0.323 | −1.371 | 41.364 |
| 0.56 | 1.503 | 40.603 |
| 0.651 | 1.598 | 40.291 |
| 0.432 | −1.422 | 40.985 |
| 1.245 | −1.076 | 39.187 |
| 1.04 | −1.756 | 39.541 |
| 0.56 | −1.503 | 40.603 |
| 0.836 | 1.368 | 39.896 |
| 0.5 | 1.828 | 41.147 |
| 0.907 | −0.598 | 39.753 |
| 0.328 | −0.598 | 40.515 |
| 1.245 | 1.74 | 39.187 |
| 0.613 | 1.379 | 40.236 |
| 0.937 | 0 | 39.72 |
| 0.305 | −1.338 | 40.988 |
| 0.476 | −1.316 | 40.309 |
| 0.836 | 1.598 | 39.896 |
| 0.5 | −1.844 | 41.509 |

TABLE 2-continued

| X | Y | Z |
|---|---|---|
| 0.836 | −1.771 | 39.896 |
| 1.04 | −0.359 | 39.541 |
| 0.347 | 1.324 | 40.637 |

TABLE 3

| X | Y | Z |
|---|---|---|
| −4.365 | −1.856 | 41.684 |
| −1.174 | 1.775 | 39.893 |
| −2.168 | 1.124 | 41.368 |
| −4.019 | 1.856 | 41.685 |
| −3.7 | −0.864 | 41.672 |
| −0.971 | −0.367 | 40.123 |
| −1.425 | 1.823 | 40.959 |
| −4.811 | −1.045 | 41.735 |
| −1.785 | −0.375 | 41.185 |
| −4.813 | −1.451 | 41.735 |
| −3.043 | 0 | 41.603 |
| −1.425 | 0.375 | 40.959 |
| −4.452 | −0.688 | 41.812 |
| −2.57 | 1.848 | 41.505 |
| −2.168 | 1.841 | 41.368 |
| −3.512 | 0 | 41.673 |
| −3.705 | 0.845 | 41.675 |
| −4.462 | −0.858 | 41.783 |
| −1.25 | 1.064 | 39.847 |
| −1.785 | 0.375 | 41.185 |
| −1.174 | −1.775 | 39.893 |
| −1.25 | −1.064 | 39.847 |
| −4.019 | 1.341 | 41.685 |
| −1.094 | −0.367 | 40.693 |
| −4.039 | −0.92 | 41.692 |
| −3.373 | −0.767 | 41.646 |
| −1.174 | 1.1 | 39.893 |
| −4.921 | 0.688 | 41.881 |
| −3.986 | −0.858 | 41.713 |
| −4.462 | 0.858 | 41.783 |
| −0.94 | 0.367 | 40.428 |
| −4.374 | 0.991 | 41.697 |
| −4.032 | 0.948 | 41.685 |
| −3.329 | 1.854 | 41.64 |
| −2.986 | −0.375 | 41.594 |
| −4.813 | −1.858 | 41.735 |
| −4.365 | 1.442 | 41.684 |
| −4.457 | 0.688 | 41.813 |
| −3.043 | 0 | 41.603 |
| −3.986 | 0.858 | 41.713 |
| −0.971 | 0.367 | 40.123 |
| −4.365 | 1.027 | 41.684 |
| −4.799 | 1.007 | 41.747 |
| −4.365 | −1.027 | 41.684 |
| −3.043 | −0.688 | 41.603 |
| −1.785 | −1.124 | 41.185 |
| −2.986 | 0.375 | 41.594 |
| −1.174 | −1.1 | 39.893 |
| −0.94 | −0.367 | 40.428 |
| −3.705 | −0.845 | 41.675 |
| −2.986 | −1.852 | 41.594 |
| −1.425 | 1.124 | 40.959 |
| −3.982 | 0.688 | 41.742 |
| −4.535 | 1.006 | 41.708 |
| −1.25 | −1.773 | 39.847 |
| −3.7 | 0.864 | 41.672 |
| −3.982 | −0.688 | 41.742 |
| −0.971 | 1.785 | 40.123 |
| −4.921 | 0 | 41.881 |
| −4.811 | 1.045 | 41.735 |
| −1.094 | 1.811 | 40.693 |
| −0.94 | 1.799 | 40.428 |
| −3.043 | 0.688 | 41.603 |
| −1.785 | −1.833 | 41.185 |
| −1.425 | −0.375 | 40.959 |
| −2.986 | 1.852 | 41.594 |
| −2.57 | −0.375 | 41.505 |

TABLE 3-continued

| X | Y | Z |
|---|---|---|
| −0.94 | −1.1 | 40.428 |
| −1.785 | 1.124 | 41.185 |
| −3.673 | −1.341 | 41.67 |
| −1.094 | 0.375 | 40.693 |
| −4.537 | 1.045 | 41.694 |
| −3.982 | −0.688 | 41.742 |
| −3.329 | −1.854 | 41.64 |
| −4.039 | 0.92 | 41.692 |
| −2.168 | 0.375 | 41.368 |
| −4.799 | −1.007 | 41.747 |
| −4.032 | −0.948 | 41.685 |
| −1.25 | 1.773 | 39.847 |
| −3.673 | −1.855 | 41.67 |
| −3.673 | 1.341 | 41.67 |
| −3.982 | 0.688 | 41.742 |
| −3.329 | 1.341 | 41.64 |
| −0.971 | 1.1 | 40.123 |
| −4.452 | 0 | 41.812 |
| −3.982 | 0 | 41.742 |
| −4.813 | 1.858 | 41.735 |
| −1.25 | 0.355 | 39.847 |
| −3.371 | 0.777 | 41.644 |
| −4.365 | 1.856 | 41.684 |
| −3.329 | −1.341 | 41.64 |
| −4.019 | −1.856 | 41.685 |
| −4.374 | −0.991 | 41.697 |
| −0.94 | 1.1 | 40.428 |
| −1.785 | 1.833 | 41.185 |
| −4.537 | 1.451 | 41.694 |
| −0.971 | −1.785 | 40.123 |
| −4.535 | −1.006 | 41.708 |
| −1.425 | −1.823 | 40.959 |
| −3.512 | −0.688 | 41.673 |
| −1.174 | −0.367 | 39.893 |
| −4.537 | −1.856 | 41.694 |
| −3.373 | 0.767 | 41.646 |
| −4.537 | −1.045 | 41.694 |
| −4.537 | −1.442 | 41.694 |
| −2.57 | 0.375 | 41.505 |
| −3.371 | −0.777 | 41.644 |
| −3.673 | 1.855 | 41.67 |
| −2.57 | −1.848 | 41.505 |
| −4.537 | 1.856 | 41.694 |
| −2.57 | 1.124 | 41.505 |
| −4.921 | −0.688 | 41.881 |
| −4.813 | 1.451 | 41.735 |
| −1.094 | −1.124 | 40.693 |
| −0.94 | −1.799 | 40.428 |
| −1.425 | −1.124 | 40.959 |
| −2.168 | −1.124 | 41.368 |
| −2.57 | −1.124 | 41.505 |
| −1.174 | 0.367 | 39.893 |
| −1.094 | 1.124 | 40.693 |
| −3.512 | 0.688 | 41.673 |
| −4.365 | −1.442 | 41.684 |
| −1.094 | −1.811 | 40.693 |
| −2.168 | −0.375 | 41.368 |
| −1.25 | −0.355 | 39.847 |
| −2.168 | −1.841 | 41.368 |
| −4.019 | −1.341 | 41.685 |
| −0.971 | −1.1 | 40.123 |
| −2.986 | −1.127 | 41.594 |
| −2.986 | 1.127 | 41.594 |

TABLE 4

| X | Y | Z |
|---|---|---|
| 2.448 | 1.1 | 40.718 |
| 2.758 | 0.367 | 40.698 |
| 2.758 | −0.367 | 40.698 |
| 2.448 | −1.1 | 40.718 |
| 3.066 | 0.367 | 40.67 |
| 4.612 | −1.795 | 40.326 |
| 3.183 | −0.688 | 40.656 |

TABLE 4-continued

| X | Y | Z |
|---|---|---|
| 3.655 | 0.688 | 40.601 |
| 3.183 | 0 | 40.656 |
| 3.183 | −0.688 | 40.656 |
| 1.244 | −0.355 | 39.851 |
| 4.123 | −0.883 | 40.505 |
| 1.049 | 1.785 | 40.119 |
| 3.68 | 1.304 | 40.586 |
| 1.517 | −1.808 | 40.615 |
| 1.823 | −0.367 | 40.682 |
| 4.616 | −1.038 | 40.343 |
| 4.612 | 1.421 | 40.326 |
| 4.612 | 1.08 | 40.326 |
| 3.183 | −0.688 | 40.656 |
| 1.052 | 1.095 | 40.353 |
| 3.683 | −0.79 | 40.587 |
| 4.384 | 1.044 | 40.388 |
| 1.049 | −1.785 | 40.119 |
| 4.401 | 1.006 | 40.398 |
| 4.384 | 1.304 | 40.388 |
| 3.374 | 1.808 | 40.632 |
| 3.066 | 1.81 | 40.67 |
| 2.135 | 0.367 | 40.716 |
| 1.823 | 0.367 | 40.682 |
| 3.066 | 1.1 | 40.67 |
| 4.126 | −0.688 | 40.545 |
| 3.655 | 0 | 40.601 |
| 4.384 | 1.797 | 40.388 |
| 2.135 | −0.367 | 40.716 |
| 1.22 | −0.367 | 40.516 |
| 1.13 | 0.361 | 39.973 |
| 3.374 | −1.1 | 40.632 |
| 2.448 | −0.367 | 40.718 |
| 4.126 | 0.688 | 40.545 |
| 1.517 | 1.808 | 40.615 |
| 3.183 | 0.688 | 40.656 |
| 1.823 | 1.811 | 40.682 |
| 4.934 | 1.437 | 40.279 |
| 5.07 | −0.688 | 40.434 |
| 1.22 | −1.1 | 40.516 |
| 1.517 | −0.367 | 40.615 |
| 4.924 | 1.046 | 40.299 |
| 4.924 | −1.046 | 40.299 |
| 3.374 | 1.1 | 40.632 |
| 4.123 | 0.883 | 40.505 |
| 3.68 | 1.1 | 40.586 |
| 1.051 | 1.796 | 40.353 |
| 4.934 | −1.792 | 40.279 |
| 3.183 | 0 | 40.656 |
| 3.183 | 0.688 | 40.656 |
| 4.401 | −1.006 | 40.398 |
| 3.183 | 0.688 | 40.656 |
| 4.155 | −1.304 | 40.471 |
| 4.155 | 1.304 | 40.471 |
| 3.68 | −1.304 | 40.586 |
| 1.051 | −1.796 | 40.353 |
| 2.448 | −1.1 | 40.718 |
| 2.448 | 0.367 | 40.718 |
| 4.048 | 0.894 | 40.51 |
| 3.655 | −0.688 | 40.601 |
| 4.598 | −0.688 | 40.49 |
| 4.039 | 0.919 | 40.506 |
| 3.68 | 1.806 | 40.586 |
| 4.128 | −0.688 | 40.545 |
| 4.934 | 1.792 | 40.279 |
| 4.601 | −0.883 | 40.449 |
| 1.049 | −1.084 | 40.119 |
| 2.135 | −1.812 | 40.716 |
| 2.448 | 0.367 | 40.718 |
| 3.68 | −1.1 | 40.586 |
| 2.448 | 1.1 | 40.718 |
| 1.823 | 1.1 | 40.682 |
| 4.612 | −1.421 | 40.326 |
| 1.052 | −0.365 | 40.353 |
| 4.126 | 0 | 40.545 |
| 1.049 | 1.095 | 40.119 |
| 1.052 | 0.365 | 40.353 |
| 4.048 | −0.894 | 40.51 |
| 4.601 | 0.883 | 40.449 |

TABLE 4-continued

| X | Y | Z |
|---|---|---|
| 2.448 | 1.812 | 40.718 |
| 4.039 | −0.919 | 40.506 |
| 2.758 | −1.811 | 40.698 |
| 1.22 | −1.803 | 40.516 |
| 2.758 | −1.1 | 40.698 |
| 3.92 | −1.804 | 40.537 |
| 3.683 | 0.79 | 40.587 |
| 1.049 | 0.365 | 40.119 |
| 5.07 | 0.688 | 40.434 |
| 1.22 | 1.095 | 40.516 |
| 1.13 | 1.084 | 39.973 |
| 2.448 | −1.812 | 40.718 |
| 3.92 | 1.804 | 40.537 |
| 4.155 | 1.801 | 40.471 |
| 3.92 | 1.304 | 40.537 |
| 1.052 | −1.095 | 40.353 |
| 4.155 | −1.801 | 40.471 |
| 4.598 | 0.688 | 40.49 |
| 1.22 | 0.365 | 40.516 |
| 2.448 | −0.367 | 40.718 |
| 3.374 | −1.808 | 40.632 |
| 2.135 | −1.1 | 40.716 |
| 4.612 | −1.08 | 40.326 |
| 1.244 | 0.361 | 39.851 |
| 1.13 | −1.084 | 39.973 |
| 5.07 | 0.688 | 40.434 |
| 2.758 | 1.811 | 40.698 |
| 1.517 | 0.367 | 40.615 |
| 1.517 | −1.1 | 40.615 |
| 1.517 | 1.1 | 40.615 |
| 4.128 | 0.688 | 40.545 |
| 1.244 | 1.084 | 39.851 |
| 4.932 | −1.09 | 40.279 |
| 4.598 | 0 | 40.49 |
| 3.68 | 0.802 | 40.586 |
| 3.066 | −1.81 | 40.67 |
| 4.384 | −1.304 | 40.388 |
| 1.823 | −1.811 | 40.682 |
| 2.758 | 1.1 | 40.698 |
| 4.932 | 1.09 | 40.279 |
| 3.68 | −1.806 | 40.586 |
| 1.244 | 1.773 | 39.851 |
| 4.384 | −1.044 | 40.388 |
| 3.92 | −1.304 | 40.537 |
| 1.823 | −1.1 | 40.682 |
| 2.135 | 1.1 | 40.716 |
| 1.049 | −0.361 | 40.119 |
| 4.384 | −1.797 | 40.388 |
| 5.07 | −0.688 | 40.434 |
| 1.244 | −1.773 | 39.851 |
| 2.135 | 1.812 | 40.716 |
| 4.616 | 1.038 | 40.343 |
| 1.13 | −0.361 | 39.973 |
| 3.066 | −1.1 | 40.67 |
| 1.244 | −1.084 | 39.851 |
| 5.07 | 0 | 40.434 |
| 1.22 | 1.803 | 40.516 |
| 3.68 | −0.802 | 40.586 |
| 4.612 | 1.795 | 40.326 |
| 4.934 | −1.437 | 40.279 |
| 3.066 | −0.367 | 40.67 |

TABLE 5

| X | Y | Z |
|---|---|---|
| −2.022 | 1.507 | 38.867 |
| −1.407 | 0 | 38.289 |
| −1.407 | −1.484 | 38.289 |
| −1.25 | 0 | 37.004 |
| −4.76 | 0 | 39.625 |
| −1.25 | 1.434 | 37.004 |
| −4.76 | 1.537 | 39.625 |
| −1.164 | 0 | 37.401 |
| −3.894 | −1.531 | 39.487 |

TABLE 5-continued

| X | Y | Z |
|---|---|---|
| −3.894 | 0 | 39.487 |
| −3.298 | 1.527 | 39.363 |
| −2.356 | −1.514 | 39.054 |
| −2.356 | 0 | 39.054 |
| −1.218 | 1.468 | 37.864 |
| −1.713 | 0 | 38.639 |
| −1.713 | 1.498 | 38.639 |
| −2.356 | 1.514 | 39.054 |
| −2.712 | 0 | 39.196 |
| −1.164 | −1.45 | 37.401 |
| −4.497 | 0 | 39.566 |
| −2.022 | −1.507 | 38.867 |
| −1.164 | 1.45 | 37.401 |
| −0.026 | 0.001 | 37.864 |
| −1.218 | 0 | 37.864 |
| −1.25 | −1.434 | 37.004 |
| −3.298 | −1.527 | 39.393 |
| −3.894 | 1.531 | 39.487 |
| −3.298 | 0 | 39.363 |
| −2.712 | 1.52 | 39.196 |
| −4.76 | −1.537 | 39.625 |
| −1.407 | 1.484 | 38.289 |
| −4.497 | 1.535 | 39.566 |
| −1.218 | −1.468 | 37.864 |
| −4.497 | −1.535 | 39.566 |
| −2.022 | 0 | 38.867 |
| −2.712 | −1.52 | 39.196 |
| −1.713 | −1.498 | 38.639 |

TABLE 6

| X | Y | Z |
|---|---|---|
| 4.163 | 1.465 | 37.805 |
| 2.873 | −1.473 | 37.997 |
| 4.724 | −0.725 | 37.713 |
| 2.366 | −1.473 | 37.989 |
| 3.771 | 1.468 | 37.882 |
| 4.163 | 0.992 | 37.805 |
| 3.378 | −0.992 | 37.948 |
| 5.234 | −1.193 | 37.461 |
| 5.33 | −0.66 | 37.616 |
| 4.192 | 0.66 | 37.809 |
| 6.034 | 1.055 | 37.441 |
| 6.034 | −1.451 | 37.441 |
| 4.552 | −1.149 | 37.718 |
| 5.234 | 1.452 | 37.461 |
| 4.728 | 0.66 | 37.716 |
| 5.682 | 0 | 37.603 |
| 5.33 | 0 | 37.616 |
| 5.564 | −0.944 | 37.519 |
| 1.25 | 1.432 | 36.968 |
| 1.548 | 1.465 | 37.807 |
| 3.378 | 0.992 | 37.948 |
| 1.165 | −1.445 | 37.286 |
| 3.656 | 0.66 | 37.903 |
| 6.034 | 0.66 | 37.589 |
| 6.034 | −0.66 | 37.589 |
| 2.366 | 0 | 37.989 |
| 5.483 | −1.303 | 37.304 |
| 2.873 | 0 | 37.997 |
| 5.329 | 0.856 | 37.576 |
| 3.378 | 1.471 | 37.948 |
| 5.213 | 1.051 | 37.476 |
| 6.034 | −0.98 | 37.474 |
| 5.088 | −1.193 | 37.549 |
| 3.378 | 0 | 37.948 |
| 5.799 | −0.66 | 37.598 |
| 5.75 | −1.443 | 37.244 |
| 2.873 | 1.473 | 37.997 |
| 1.548 | 0 | 37.807 |
| 4.931 | −1.193 | 37.613 |
| 5.483 | −1.446 | 37.304 |
| 6.034 | −0.66 | 37.589 |
| 5.483 | 1.446 | 37.304 |

TABLE 6-continued

| X | Y | Z |
|---|---|---|
| 2.366 | 1.473 | 37.989 |
| 5.75 | −1.303 | 37.244 |
| 5.565 | 0.66 | 37.607 |
| 3.656 | 0 | 37.903 |
| 6.034 | 0 | 37.589 |
| 3.378 | −1.471 | 37.948 |
| 1.289 | 1.457 | 37.592 |
| 1.864 | −1.47 | 37.924 |
| 4.552 | 1.462 | 37.718 |
| 4.163 | −0.992 | 37.805 |
| 6.034 | 0 | 37.589 |
| 3.771 | −1.468 | 37.882 |
| 4.185 | 0.725 | 37.806 |
| 4.552 | −1.462 | 37.718 |
| 4.724 | 0.725 | 37.713 |
| 6.034 | 1.451 | 37.441 |
| 5.483 | 1.303 | 37.304 |
| 5.088 | 1.455 | 37.549 |
| 4.728 | 0 | 37.716 |
| 1.165 | 1.445 | 37.286 |
| 5.564 | 0.944 | 37.519 |
| 3.771 | 0.992 | 37.882 |
| 5.234 | −1.452 | 37.461 |
| 4.931 | 1.458 | 37.613 |
| 5.234 | 1.193 | 37.461 |
| 4.163 | −1.465 | 37.805 |
| 4.552 | −0.836 | 37.718 |
| 1.289 | −1.457 | 37.592 |
| 5.799 | 0.66 | 37.598 |
| 6.034 | 0.83 | 37.559 |
| 4.552 | 0.836 | 37.718 |
| 5.088 | −1.455 | 37.549 |
| 4.931 | −1.458 | 37.613 |
| 4.931 | 0.927 | 37.613 |
| 5.75 | 1.443 | 37.244 |
| 6.034 | 0.66 | 37.589 |
| 5.079 | −0.983 | 37.553 |
| 1.165 | 0 | 37.286 |
| 6.034 | −0.83 | 37.559 |
| 4.931 | 1.193 | 37.613 |

At this point it should be understood that the exemplary embodiments describe near flow path seal members that prevent or at least substantially limit fluid exchange between a gas path and a wheel space in a turbomachine. The near flow path seal members include surface sections that are shaped to provide desired clearances for moving components while at the same time ensuring sealing properties. It should also be understood that the particular points that define the surface section can vary and includes a tolerance of up to ±0.250 for each surface section.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A near flow path seal member for a turbomachine comprising:

a seal body including a seal support member having a first end portion that extends to a second end portion through an intermediate portion;

an arm member extending from the first end portion of the seal body, the arm member having a first end that extends to a second end to define an axial dimension of the arm member, a first edge that extends to a second, opposing edge to define a circumferential dimension of the arm member, and a surface having a profile that establishes a thickness variation of the arm member in each of the axial dimension and the circumferential dimension;

another arm member extending from the first end portion of the seal body, the another arm member having a first end that extends to a second end to define an axial dimension of the another arm member, a first edge that extends to a second, opposing edge to define a circumferential dimension of the another arm member, and another surface having a profile that establishes a thickness variation of the another arm member in each of the axial dimension and the circumferential dimension, wherein the near flow path seal member is configured and disposed to seal between one of a first stage and a second stage, a second stage and a third stage, and a third stage and a fourth stage of a turbine.

2. The near flow path seal member according to claim 1, wherein the arm member comprises an upstream arm member and the another arm member comprises a downstream arm member.

3. The near flow path seal member according to claim 1, wherein the near flow path seal member is configured and disposed to seal between a first stage and a second stage of a turbine.

4. The near flow path seal member according to claim 1, wherein the profile of the surface is substantially in accordance with Cartesian coordinate values of X, Y, and Z set forth in TABLE 1, and wherein X, Y, and Z are distances in inches which, when connected by smooth continuing arcs, define the profile of the surface.

5. The near flow path seal member according to claim 1, wherein the profile of the another surface is substantially in accordance with Cartesian coordinate values of X, Y, and Z set forth in TABLE 2, and wherein X, Y, and Z are distances in inches which, when connected by smooth continuing arcs, define the profile of the another surface.

6. The near flow path seal member according to claim 1, wherein the near flow path seal member is configured and disposed to seal between a second and a third stage of a turbine.

7. The near flow path seal member according to claim 6, wherein the profile of the surface is substantially in accordance with Cartesian coordinate values of X, Y, and Z set forth in TABLE 3, and wherein X, Y, and Z are distances in inches which, when connected by smooth continuing arcs, define the profile of the surface.

8. The near flow path seal member according to claim 6, wherein the profile of the another surface is substantially in accordance with Cartesian coordinate values of X, Y, and Z set forth in TABLE 4, and wherein X, Y, and Z are distances in inches which, when connected by smooth continuing arcs, define the profile of the another surface.

9. The near flow path seal member according to claim 1, wherein the near flow path seal member is configured and disposed to seal between a third stage and a fourth stage of a turbine.

10. The near flow path seal member according to claim 9, wherein the profile of the surface is substantially in accordance with Cartesian coordinate values of X, Y, and Z set forth in TABLE 5, and wherein X, Y, and Z are distances in inches which, when connected by smooth continuing arcs, define the profile of the surface.

11. The near flow path seal member according to claim 9, wherein the profile of the another surface is substantially in accordance with Cartesian coordinate values of X, Y, and Z set forth in TABLE 6, and wherein X, Y, and Z are distances in inches which, when connected by smooth continuing arcs, define the profile of the another surface.

12. A turbomachine comprising:

a compressor portion;

a combustor assembly fluidly connected to the compressor portion;

a turbine portion fluidly connected to the combustor assembly and mechanically linked to the compressor portion, the turbine portion including a first stage, a second stage, a third stage, and a fourth stage; and a near flow path seal member positioned between one of the first, second, third, and fourth stages of the turbine portion, the near flow path seal member comprising:

a seal body including a seal support member having a first end portion that extends to a second end portion through an intermediate portion; and an arm member extending from the first end portion of the seal body, the arm member having a first end that extends to a second end to define an axial dimension of the arm member, a first edge that extends to a second, opposing edge to define a circumferential dimension of the arm member, and a surface having a profile that establishes a thickness variation of the arm member in each of the axial dimension and the circumferential dimension another arm member extending from the first end portion of the seal body, the another arm member having a first end that extends to a second end to define an axial dimension of the another arm member, a first edge that extends to a second, opposing edge to define a circumferential dimension of the another arm member, and another surface having a profile that establishes a thickness variation of the another arm member in each of the axial dimension and the circumferential dimension, wherein the near flow path seal member is configured and disposed to seal between one of a first stage and a second stage, a second stage and a third stage, and a third stage and a fourth stage of the turbine portion.

13. The turbomachine according to claim 12, wherein the near flow path seal is positioned between the first and second stage of the turbine portion and the profile of the surface is substantially in accordance with Cartesian coordinate values of X, Y, and Z set forth in TABLE 1, and wherein X, Y, and Z are distances in inches which, when connected by smooth continuing arcs, define the profile of the surface.

14. The turbomachine according to claim 12, wherein the near flow path seal is positioned between the first and second stage of the turbine portion and the profile of the another surface is substantially in accordance with Cartesian coordinate values of X, Y, and Z set forth in TABLE 2, and wherein X, Y, and Z are distances in inches which, when connected by smooth continuing arcs, define the profile of the another surface.

15. The turbomachine according to claim 12, wherein the near flow path seal is positioned between the second and third stage of the turbine portion and the profile of the surface is substantially in accordance with Cartesian coordinate values of X, Y, and Z set forth in TABLE 3, and wherein X, Y, and Z are distances in inches which, when connected by smooth continuing arcs, define the profile of the surface.

16. The turbomachine according to claim 12, wherein the near flow path seal is positioned between the second and third stage of the turbine portion and the profile of the another surface is substantially in accordance with Cartesian coordinate values of X, Y, and Z set forth in TABLE 4, and wherein X, Y, and Z are distances in inches which, when connected by smooth continuing arcs, define the profile of the another surface.

17. The turbomachine according to claim 12, wherein the near flow path seal is positioned between the third and fourth stage of the turbine portion and the profile of the surface is substantially in accordance with Cartesian coordinate values of X, Y, and Z set forth in TABLE 5, and wherein X, Y, and Z are distances in inches which, when connected by smooth continuing arcs, define the profile of the surface.

18. The turbomachine according to claim 12, wherein the near flow path seal is positioned between the third and fourth stage of the turbine portion and the profile of the another surface is substantially in accordance with Cartesian coordinate values of X, Y, and Z set forth in TABLE 6, and wherein X, Y, and Z are distances in inches which, when connected by smooth continuing arcs, define the profile of the another surface.

* * * * *